United States Patent [19]

Ginzburg

[11] Patent Number: 4,813,258

[45] Date of Patent: Mar. 21, 1989

[54] ASSEMBLED FLEXIBLE EDGE ROLL

[75] Inventor: Vladimir B. Ginzburg, Pittsburgh, Pa.

[73] Assignee: United Engineering, Inc., Pittsburgh, Pa.

[21] Appl. No.: 3,348

[22] Filed: Jan. 14, 1987

[51] Int. Cl.[4] ..... B21B 27/02; B21B 29/00

[52] U.S. Cl. ..... 72/241; 29/113.2; 72/243

[58] Field of Search ..... 72/243, 245, 247, 199, 72/241; 29/113 R, 113 AD, 116 R, 116 AD, 110

[56] References Cited

U.S. PATENT DOCUMENTS

| | | | |
|---|---|---|---|
| 242,058 | 5/1881 | Schurmann | 29/116 AD |
| 2,187,250 | 1/1940 | Sendzimir | 29/116 AD X |
| 3,750,246 | 8/1973 | Pessen | 29/116 AD X |
| 3,840,958 | 10/1974 | Mahn | 29/116 AD X |
| 4,407,151 | 10/1983 | Glonbech | 72/241 |
| 4,599,770 | 7/1986 | Kato et al. | 72/243 X |
| 4,601,188 | 7/1986 | Sendzimir | 72/243 |
| 4,602,408 | 7/1986 | Noe et al. | 29/116 AD X |
| 4,683,744 | 8/1987 | Ginzburg et al. | 72/243 |

FOREIGN PATENT DOCUMENTS

| | | | |
|---|---|---|---|
| 0141302 | 7/1985 | Japan | 72/247 |

*Primary Examiner*—Robert L. Spruill
*Assistant Examiner*—Steven B. Katz
*Attorney, Agent, or Firm*—Kirkpatrick & Lockhart

[57] ABSTRACT

A pair of self-compensating backup rolls for use in a rolling mill. The backup rolls are sleeved and have relief means along oppositely arranged end portions to absorb dynamically generated roll bending forces.

6 Claims, 4 Drawing Sheets

ASSEMBLED FLEXIBLE EDGE ROLL

BACKGROUND OF THE INVENTION

1. Field of the Invention

This invention relates to self-compensating, flexible edge, backup rolls for use in a rolling mill stand.

2. Description of the Prior Art

In the hot and cold rolling of strip metal, workers in the art continually seek improvements in both the quality of the strip produced by rolling and the cost effectiveness of the rolling operation. Among the factors that contribute to strip quality is the stability of the strip profile. Control of strip profile may, in turn, involve a variety of techniques and devices, applied both statically and dynamically.

A contribution to the overall improvement in strip profile control occurred with the discovery of the so-called "undesirable" contact zones between work rolls and backup rolls, outboard of the transverse profile of the strip, in a conventional four-high (and six-high) rolling mill. The effects of these undesirable zones are most pronounced when the strip width is less than the barrel length of the backup rolls. A solution to the undesirable contact zones problem was found in the use of stepped backup rolls or some other strip profile actuator that simulates that concept; e.g., axially shiftable rolls, both cylindrical and noncylindrical; axially shiftable sleeved rolls (see e.g. Japanese Patent No. 55-86606), etc.

As further work on strip profile control progressed, workers were led to appreciate the need for improved efficiency in the handling of work roll bending forces. This appreciation was manifested in attempts at softening the edges of the backup rolls to increase the overall dynamic flexibility of the roll system. A number of flexible edge roll systems have been proposed for sleeved rolls including those exemplified in U.S. Pats. Nos. 2,187,250; 3,097,590; and 4,599,770. Other rolls sleeve edge deflection schemes are shown in Japanese Patents Nos. 57-68206; 58-192104 and 59-54401.

More recent proposals involving flexible edge rolls are contained in U.S. patent application Ser. No. 746,376, now U.S. Pat. No. 4,683,744 filed June 18, 1985, entitled FLEXIBLE EDGE ROLL and U.S. patent application Ser. No. 795,577, filed Nov. 6, 1985, entitled SELF-COMPENSATING ROLL. The present invention is an improvement on the latter which discloses a backup roll having a sleeve shrunk fit on an arbor at its central portion so that the edge portions of the sleeve are free to deflect. Dynamic strip profile control is achieved with the self-compensating roll of U.S. Ser. No. 795,577, now U.S. Pat. No. 4,722,212 but a certain amount of inflexibility persists in the roll system by virtue of the rigid connection between sleeve and arbor at the center of the roll.

SUMMARY OF THE INVENTION

The present invention requires the use of two backup rolls, each having self-comensation means at an opposite end in the roll stack. The two backup rolls work together to provide compensation against roll bending forces created by forces generated in the mull stand during rolling of strip material (hereinafter "rolling forces").

The present invention provides in a sleeved backup roll adapted for use in a rolling mill stand with a second, like backup roll oppositely oriented in the mill stand, the sleeved backup roll including an arbor member and a sleeve member concentrically mounted thereon, an improved mounting arrangement comprising: a first portion of the sleeve member being in rigid contact with the arbor member along a portion of its length extending from a first end toward the center, the rigid contact being maintained by mechanical securement means including means for preventing axial sliding movement of the sleeve member toward the first end of the arbor member; and a second portion of the sleeve member being normally out of contact with the arbor member along a portion of its length extending from a second end, opposite the first end, toward the center. The rigid contact between the first portion of the sleeve member and the arbor member may extend from the first end of the arbor member to a point short of the center of the arbor member or to the center.

The present invention also provides in a rolling mill stand, a pair of vertically spaced, sleeved backup rolls adapted for compensating rolling forces created by rolling a metal strip workpiece through an adjacent pair of work rolls, the compensation means being operative at an opposite end of each of the backup rolls and comprising: an arbor member having opposed ends adapted for mounting in the rolling mill stand; a sleeve member concentrically mounted on the arbor member and having: (i) a first portion in rigid contact with the arbor member along a portion of its length extending from a first end toward the center; and (ii) a second portion normally out of contact with the underlying adjacent surface of the arbor member, thereby forming an annular cavity therebetween; the annular cavity being so shaped as to produce a desired distribution of rolling forces across the workpiece. In one form of the invention, the annular cavity extends from a second end of the arbor member, opposite the first end, to a point beyond the midpoint of the arbor member.

Preferably, the surface of the portion of the arbor forming the annular cavity is tapered, for example, transversely parabolic, to permit increased contact between the sleeve and the arbor as rolling bending forces increase.

Further, the present invention provides in a rolling mill stand, a pair a pair of adjacent work rolls, each of the sleeved backup rolls including an arbor member and a sleeve member concentrically mounted thereon, the improvement comprising means operative between the arbor member and the sleeve member for rigidly connecting the sleeve member to the arbor member only at one end of the backup roll, thereby providing annular relief means between the arbor memeber and the sleeve member at the opposite end of the backup roll; and the backup rolls being mounted in the rolling mill stand in opposite end-to-end relation so that annular relief means spans the width of the work rolls.

Other details and advantages of the present invention will become apparent from the following detailed description, taken with the accompanying drawings in which:

DETAILED DESCRIPTION OF THE PREFERRED EMBODIMENTS

Figure 1:
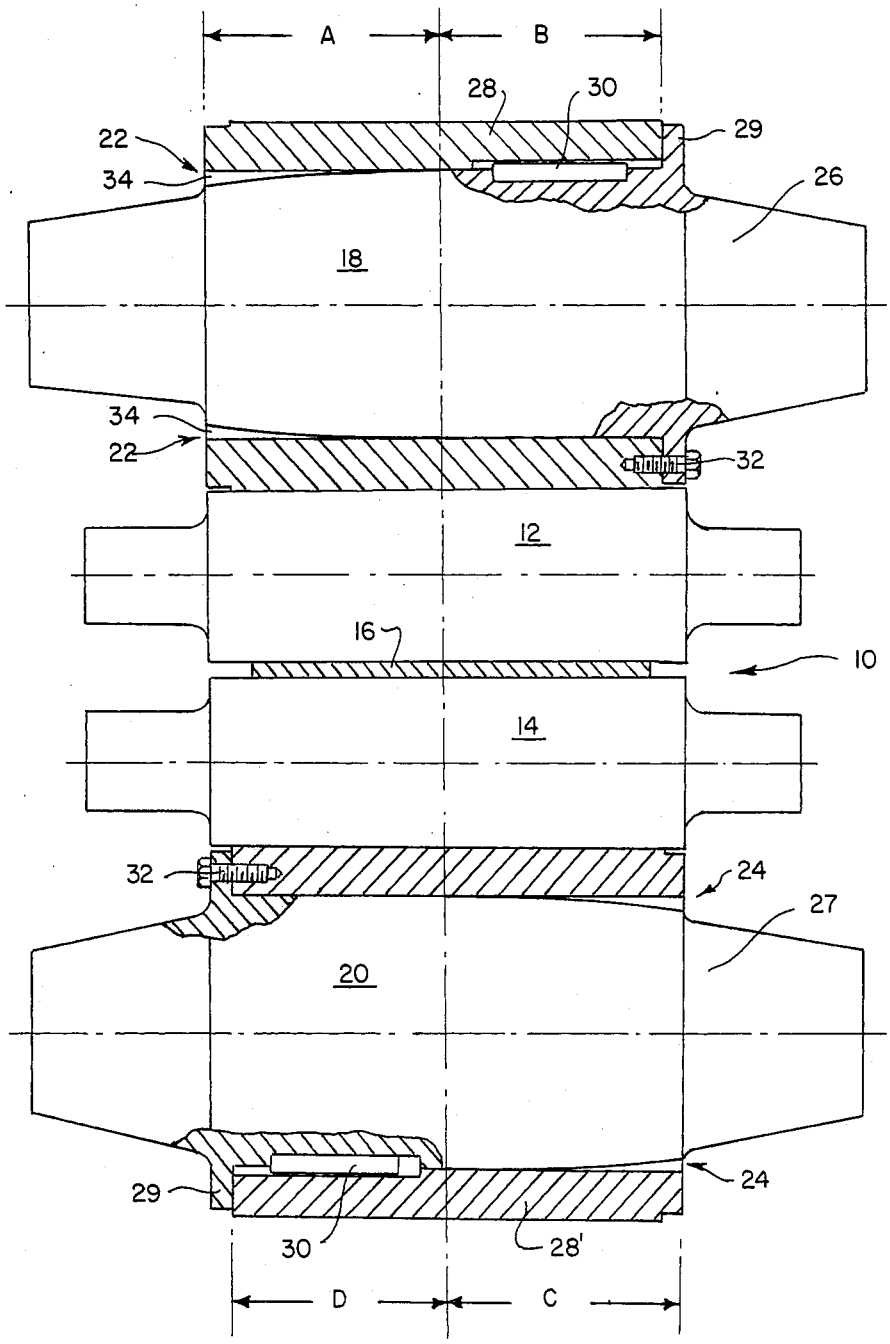
FIG. 1 is a schematic front elevational view, partly in section, of a four-high rolling mill illustrating an embodiment of the present invention.

Referring to the drawings, particularly to FIG. 1, there is shown schematically a conventional four-high rolling mill, generally designated by the reference numeral 10, with the mill stand not shown. A pair of conventional work rolls 12, 14 are mounted in mill 10 and act upon metal strip 16 during the rolling operation. Work rolls 12, 14 are backed up in the mill stand by a pair of vertically-spaced, sleeved backup rolls, generally designated by the reference numerals 18, 20. Backup rolls 18, 20 embody the present invention, but are mounted in the mill stand and function with respect to work rolls 12, 14 in the conventional way.

Backup rolls 18, 20 include bending force compensation means generally designated by the reference numerals 22, 24, respectively. As is apparent in FIG. 1, the structure and operation of backup rolls 18 and 20 are identical; the sole difference is that they are oppositely oriented in the mill stand so that their respective compensaiton means 22, 24 operate symmetrically with respect to strip 16. Accordingly, in this embodiment, as well as the embodiments illustrated in FIGS. 2–3, only one backup roll will be described.

Backup roll 18 includes an arbor member 26 and a sleeve member 28 concentrically mounted thereon. Sleeve member 28 is in rigid contact with arbor member 26 only in the zone designated "B" in FIG. 1; that is, a zone extending from the right end of arbor member 26 to about the midpoint thereof. As shown in FIG. 1, sleeve member 28 is mounted by assembly means including a conventional key and keyway, designated by the numeral 30, and a bolt 32. Sleeve member 28 may also be mounted on arbor member 26 by a shrink fit. As part of the conventional mounting of backup roll 18, there are external thrust bearings (not shown) which receive the ends of arbor member 26 and prevent any axial movement thereof. Any tendency for sleeve member 28 to move axially to the right is prevented by thrust plate 29 which may be a separate component (as shown in FIGS. 1 and 3) or be formed integrally with sleeve 28 (see FIG. 2).

In the zone designated "A" in FIG. 1, which extends from the left end of arbor member 26 to about the midpoint thereof, sleeve member 28 is not in rigid contact with the adjacent underlying surface of arbor member 26 and thus the sleeve within zone A is free to deflect with respect to arbor member 26. Preferably, the gap or annulus 34 formed between sleeve member 28 and arbor member 26 (as shown in exaggerated form in the drawings) becomes increasingly wide from right to left; this arrangement is brought about by machining either arbor member 26 in zone A, sleeve member 28 in zone A, or both, with a transversely tapered surface, for example, a parabolic surface.

Figure 4:
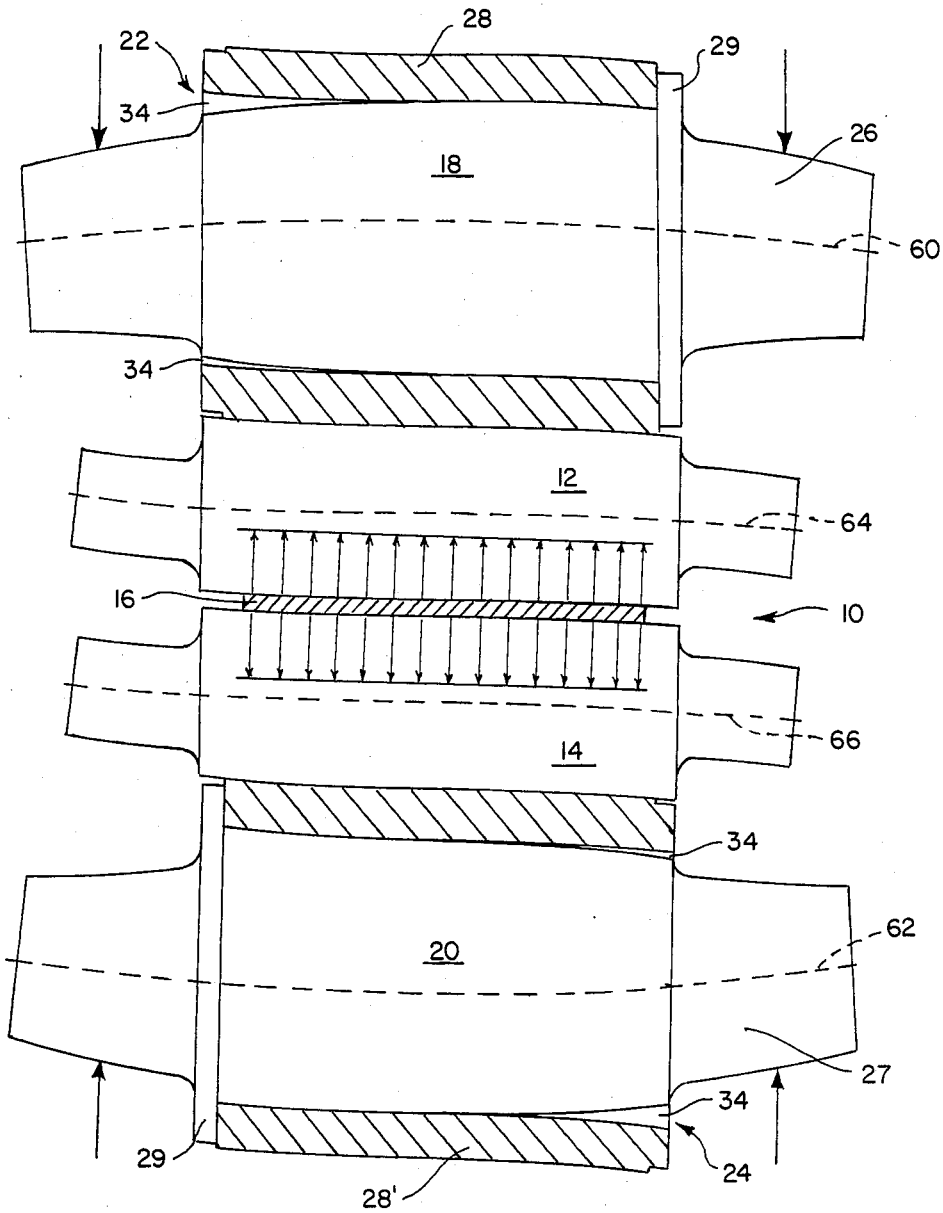
FIG. 4 is a schematic diagram, similar to FIG. 1, showing the generation of rolling forces with the mill stand and their consequences.

Referring to FIG. 4, as strip 16 is rolled between work rolls 12, 14, rolling forces are generated within mill stand 10 by reason of the resistance to rolling offered by strip 16. These rolling forces tend to deflect (exaggeratedly as depicted in the drawings) backup rolls 18, 20, more specifically the arbor members 26, 27 of those rolls in the manner illustrated in FIG. 4 by the chain lines drawn through the central axes 60, 62 of arbor members 26, 27, respectively.

Because the right side of sleeve 28 and the left side of sleeve 28′ are in rigid contact with their respective arbor members, those sides deflect in conformance with the deflection of the portions of their arbor members with which they are in contact. These deflections, in turn, deflect the (right and left) portions of work rolls 12, 14 that contact the right and left sides, respectively, of backup rolls 18, 20. The chain lines 64, 66, representing the central axes of work rolls 12, 14, respectively, illustrate these deflections.

The deflection of arbor members 26, 27 produces different results in the left and right sides of work rolls 12, 14 because of the presence of compensating means 22, 24, respectively. The presence of annular cavities 34 results in no deflection of the top left and bottom right portions of sleeves 28, 28′, respectively, by reason of the rolling forces. At the bottom of the left and top right portions of sleeves 28, 28′, however, there is contact between the adjacent portions of the cooperative work rolls 12, 14 and the exterior surface of the sleeve by reason of the rolling forces; this contact, for example between sleeve member 28 and work rolls 12, produces a component of force tending to slide sleeve member 28 axially to the right. As indicated above, however, that tendency is countered by thrust plate 29.

The presence of cavities 34 between the respective sleeve and arbor members in the left and right portions, respectively, of backup rolls 18, 20 permits the adjacent portions of work rolls 12, 14 to be relieved equally and identically from the application of rolling forces. The net effect is a bending of those portions of work rolls 12, 14 away from strip 16 to produce the overall deflection shown by chain lines 64, 66.

In the instance illustrated by FIG. 4, it is desired to achieve a uniform force distribution across strip 16 and that situation is shown by the equal lines of force. This uniform distribution obtains because a constant roll gap has been preserved across the width of strip 16 and, even though strip 16 is shown as being transversely deflected, when strip 16 is removed from mill stand 10, the strip will be substantially flat. If it were desired to form a crown in strip 16, one way would be to apply the roll bending forces to the roll system in mill stand 10. In such case, the rolling forces across strip 16 would not be uniform.

An important advantage of the present invention is that compensating means 22, 24 present on the left and right sides, respectively, of backup rolls 18, 20 permit instantaneous response to work roll bending produced by the rolling forces; and thus dynamic control of strip profile is enhanced.

Figure 2:
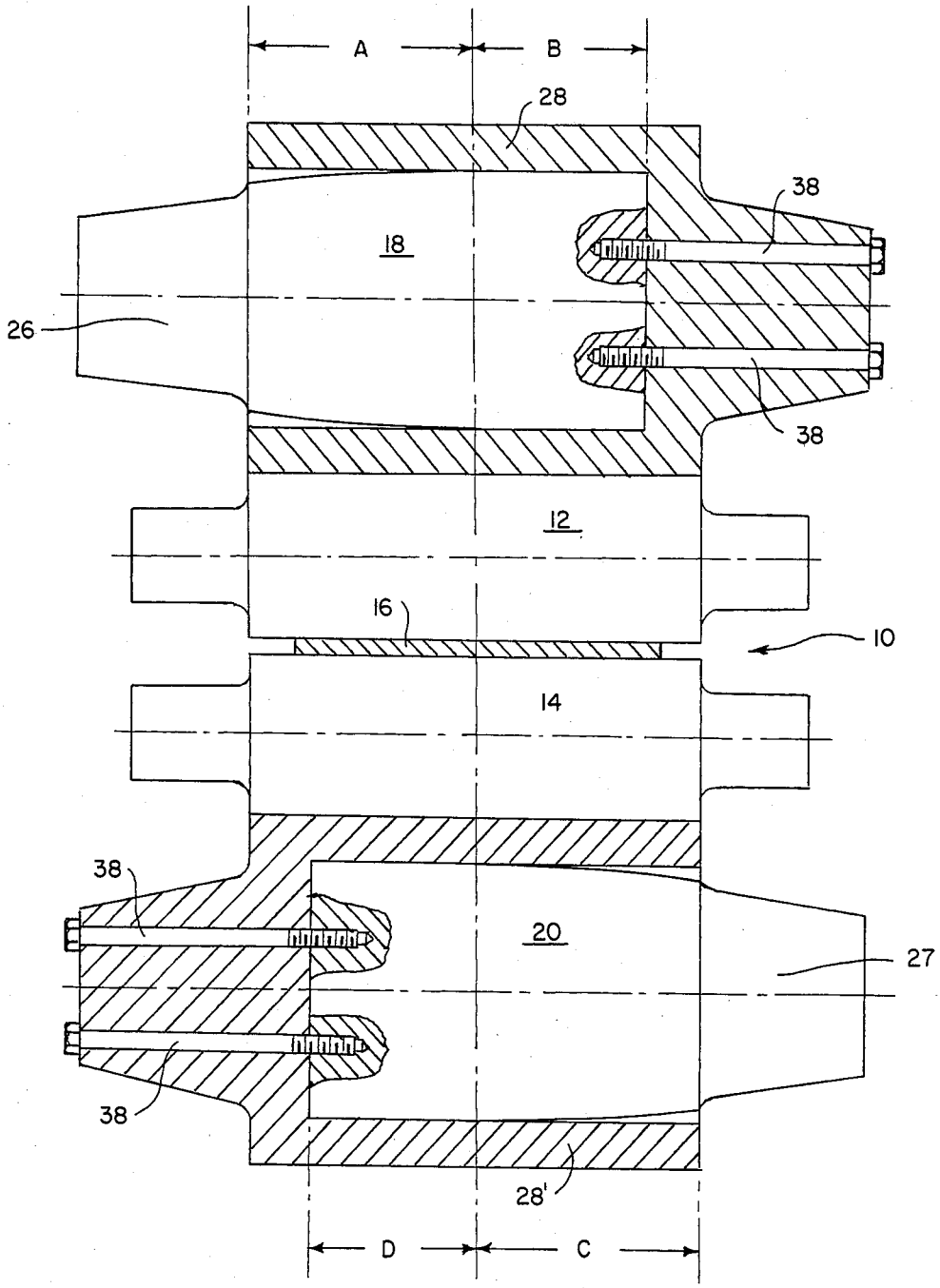
FIG. 2 is a view similar to FIG. 1, illustrating a second embodiment of the invention.
Figure 3:
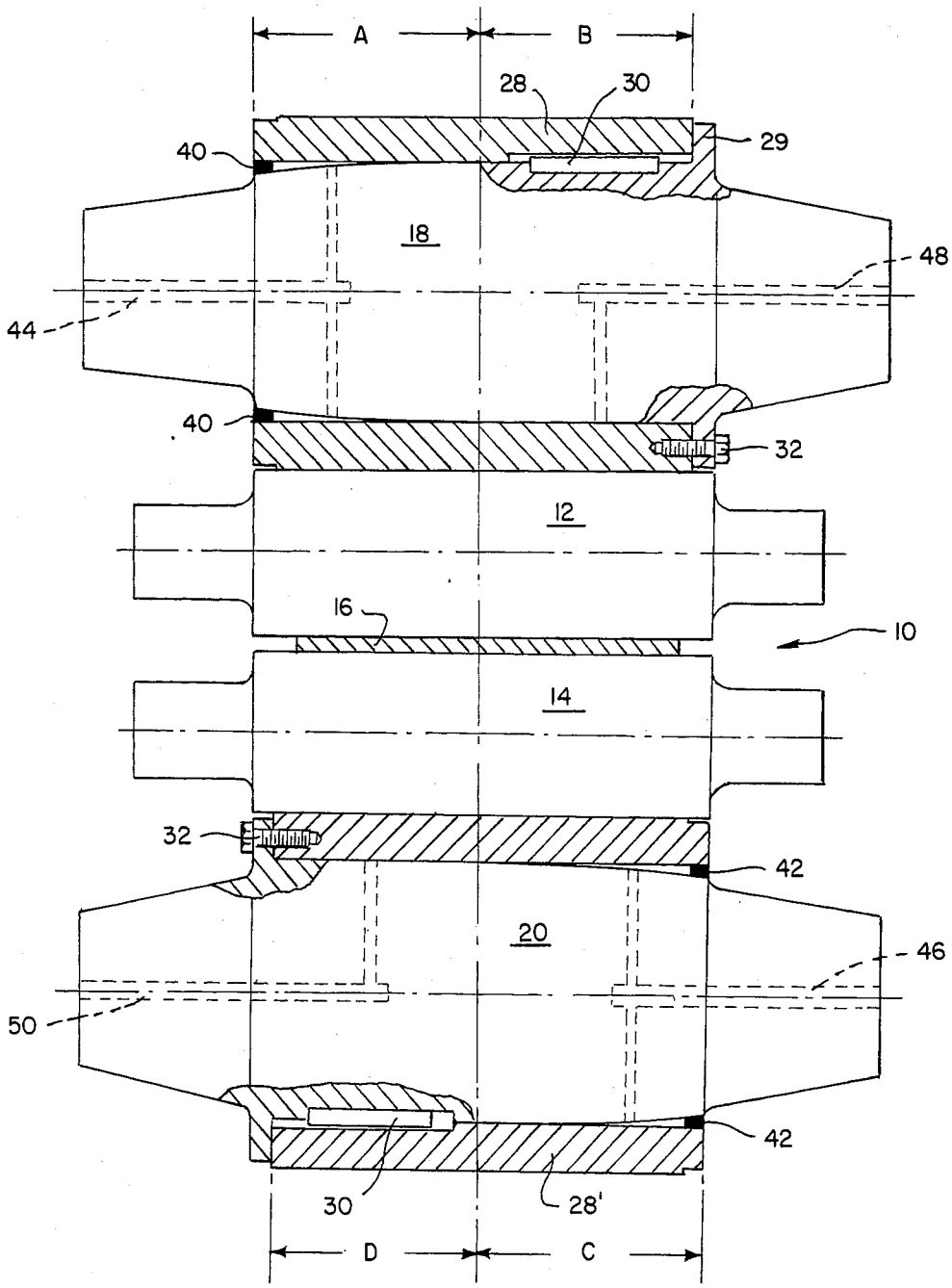
FIG. 3 is a view similar to FIG. 1, illustrating a third embodiment of the present invention.

Referring to FIGS. 2–3, which show alternate embodiments of structure used in the present invention (and wherein like parts to the parts in FIG. 1 bear identical reference numbers), FIG. 2 shows a sleeve 28 mounted to arbor member 26 by means of symmetrically arranged bolts 38. The embodiment of FIG. 3 is similar to that of FIG. 1 with the addition of seals 40, 42 at the ends of backup rolls 18, 20, respectively, to provide cavities for the application of pressurized fluid through channels 44, 46, respectively, to produce deflection of sleeve 28. Channels 48, 50 may be used during removal of sleeve member 28 from arbor member 26 to relieve the fit therebetween by the application of pressurized fluid.

What is claimed is:

1. In a sleeved backup roll adapted for use in a rolling mill stand with a second, like backup roll oppositely oriented in said mill stand, said sleeved backup roll including an arbor member and a sleeve member concentrically mounted thereon, an improved mounting arrangement comprising:

a first portion of said sleeve member being in rigid contact with said arbor member along its length extending from a first end toward the approximate center thereof, said rigid contact being maintained by mechancial securement means including means for preventing axial sliding movement of said sleeve member; and a second portion of said sleeve member being normally out of contact with said arbor member along a portion of its length extending from a second end, opposite said first end, toward the center; said out of contact portion extending from the approximate center of said arbor member to said second end thereof.

2. The improved mounting arrangement recited in claim 1 wherein:

said means for preventing axial sliding movement of said sleeve member includes a thrust plate mounted on said first end of said arbor member.

3. The improved mounting arrangement recited in claim 2 wherein:

said mechanical securement means includes a plurality of bolts extending through said thrust plate and threadedly connected to said arbor member.

4. In a rolling mill stand, a pair of vertically speed, sleeved backup rolls adapted for compensating rolling forces created by rolling a metal strip workpiece through an adjacent pair of work rolls, the compensation means being operative at an opposite end of each of said backup rolls and comprising:

an arbor member having opposed end adapted for mounting in said rolling mill stand;

a sleeve member concentrically mounted on said arbor member and having:

(i) a first portion in rigid contact with said arbor member along a portion of its length extending from a first end to approximately the center thereof; and (ii) a second portion normally out of contact with the underlying adjacent surface of said arbor member, thereby forming an annular cavity therebetween extending from a second end of said arbor member to approximately the center thereof.

5. The compensation means recited in claim 4 wherein:

said annular cavity extends from a second end of said arbor member, opposite said first end, to a point beyond the midpoint of said arbor member.

6. In a rolling mill stand, a pair of vertically spaced, sleeved backup rolls for a pair of adjacent work rolls, each of said sleeved backup rolls including an arbor member and a sleeve member concentrically mounted thereon, the improvement comprising:

means operative between said arbor member and said sleeve member for rigidly connecting said sleeve member to said arbor member only at one end of said backup roll, thereby providng annular relief means between said arbor member and said sleeve member at the opposite end of said backup roll; and said backup rolls being mounted in said rolling mill stand in opposed end-to-end relation so that said annular relief means spans the width of said work rolls.

* * * * *

UNITED STATES PATENT AND TRADEMARK OFFICE

CERTIFICATE OF CORRECTION

PATENT NO. : 4,813,258

DATED : March 21, 1989

INVENTOR(S) : Vladimir B. Ginzburg

It is certified that error appears in the above-identified patent and that said Letters Patent is hereby corrected as shown below:

Col. 1, line 60, delete "self-comensation" and substitute therefor --self-compensation--.

Col. 1, line 63, delete "mull" and substitute therefor --mill--.

Col. 2, line 53, delete "memeber" and substitute therefor --member--.

Col. 2, line 55, delete "opposite" and substitute therefor --opposed--.

Col. 3, line 4, delete "with" and substitute therefor --within--.

Col. 3, line 26, delete "compensaiton" and substitute therefor --compensation--.

Col. 5, line 33, delete "speed" and substitute therefor --spaced--.

UNITED STATES PATENT AND TRADEMARK OFFICE

CERTIFICATE OF CORRECTION

PATENT NO. : 4,813,258

DATED : March 21, 1989

INVENTOR(S) : Vladimir B. Ginzburg

It is certified that error appears in the above-identified patent and that said Letters Patent is hereby corrected as shown below:

Col. 6, line 3, delete "end" and substitute --ends--.

Signed and Sealed this

Fifth Day of December, 1989

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,813,258
DATED : March 21, 1989
INVENTOR(S) : Vladimir B. Ginzburg It is certified that error appears in the above-indentified patent and that said Letters Patent is hereby corrected as shown below:

On the title page,

Under "Assignee", delete "United Engineering, Inc., Pittsburgh, Pa." and substitute therefor --International Rolling Mill Consultants, Inc. and United Engineering, Inc., jointly, both of Pittsburgh, Pa.--

Signed and Sealed this

Twelfth Day of October, 1993

*Attest:*

*Attesting Officer*

Bruce Lehman

BRUCE LEHMAN

*Commissioner of Patents and Trademarks*